US009534866B1

(12) United States Patent
Gianakos

(10) Patent No.: US 9,534,866 B1
(45) Date of Patent: Jan. 3, 2017

(54) BLADE ATTACHMENT FOR FIREARMS

(71) Applicant: Theo Gianakos, Douglaston, NY (US)

(72) Inventor: Theo Gianakos, Douglaston, NY (US)

( * ) Notice: Subject to any disclaimer, the term of this patent is extended or adjusted under 35 U.S.C. 154(b) by 0 days.

(21) Appl. No.: 14/796,053

(22) Filed: Jul. 10, 2015

(51) Int. Cl.
*F41C 27/16* (2006.01)
*F41C 23/20* (2006.01)

(52) U.S. Cl.
CPC ..... *F41C 27/16* (2013.01); *F41C 23/20* (2013.01)

(58) Field of Classification Search
CPC ..... F41C 27/16; F41C 27/18; F41C 27/00; F41C 23/20
USPC ..... 42/86
See application file for complete search history.

(56) References Cited

U.S. PATENT DOCUMENTS

| | | | | |
|---|---|---|---|---|
| 546,344 | A | 9/1895 | Prasse | |
| 1,290,807 | A | 1/1919 | Tomanek | |
| 2,098,139 | A | 11/1937 | Foley et al. | |
| 6,807,763 | B1 | 10/2004 | Leung | |
| 7,146,762 | B1 | 12/2006 | Leung | |
| 2014/0215884 | A1 | 8/2014 | Adcock, Jr. | |
| 2014/0230303 | A1 | 8/2014 | Rice | |
| 2015/0027021 | A1* | 1/2015 | Peacemaker | F41C 23/08 42/74 |
| 2016/0153742 | A1* | 6/2016 | Copeland | F41C 27/16 42/72 |

FOREIGN PATENT DOCUMENTS

| | | | |
|---|---|---|---|
| GB | 18921 | * | 0/1912 |
| WO | WO2014106250 | | 7/2014 |

* cited by examiner

*Primary Examiner* — Stephen M Johnson
(74) *Attorney, Agent, or Firm* — Goldstein Law Offices, P.C.

(57) ABSTRACT

A blade attachment adapted for use with a firearm having a recoil adjusting plate with a plate aperture and a recoil adjusting plate coupler, as part of a combined firearm and blade assembly. The firearm has a stock with a butt end having a butt end aperture. The firearm has a rear stock aperture and a rear stock coupler. The attachment has an anchoring component including a tongue having a tongue aperture, and a blade component including a collar having a collar aperture and a blade. A method for coupling the attachment to the firearm includes inserting the tongue between the plate and the butt end, aligning the tongue aperture with the plate aperture and butt end aperture, aligning the collar aperture with the rear stock aperture, and employing the plate coupler and rear stock coupler to secure the blade attachment therebetween. The blade can have variably shaped blade edges.

15 Claims, 7 Drawing Sheets

BLADE ATTACHMENT FOR FIREARMS

TECHNICAL FIELD

The present disclosure relates generally to a blade attachment for firearms. More particularly, the present disclosure relates to a combined firearm and blade assembly including a blade attachment which can be retroactively fitted between a rifle butt and at least one of a butt plate or a recoil pad for use as a weapon in close combat confrontations.

BACKGROUND

While the adage "don't bring a gun to a knife fight" often rings true when considering that an opponent might be armed with a firearm, the inverse is not necessarily the case when engaging in close combat encounters with said opponent. This is especially true when considering the benefits that a knife can provide in self-defense. For instance, when in close proximity to his opponent, a person armed with a knife is given a clear tactical advantage where the opponent's firearm is not already drawn. The opponent is often unable to unholster and aim the firearm before the person succeeds in executing a close combat attack with his knife.

As a result, a number of combination firearm and knife weapons have been designed which seek to make knives readily available to a fighter in combat. Many of these combination weapons, however, require expensive, uniquely designed firearms which included an added knife chamber into which the knives can retract. Because of this retractability, the firearms often include complicated deployment mechanisms which makes the knives cumbersome to deploy from the firearm and use for immediate close combat action. Yet other knives are configured to extend along the barrel of the firearms, making an array of combat maneuvers difficult and/or impossible to execute, and the combined firearm and knife weapons impractical to use.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a firearm accessory which enables a firearm to be optimally used in close combat encounters. Accordingly, the present disclosure provides a blade attachment configured adapted for use with a firearm having a shaft with a butt end, a recoil adjusting plate, and a plurality of apertures and associated couplers throughout. The blade attachment including a blade component and an anchoring component which can be operably coupled between the butt end and the recoil adjusting plate to form a combined firearm and blade assembly.

Another aspect of an example embodiment in the present disclosure is to provide a blade attachment which can be retroactively fitted to an existing firearm. Accordingly, the blade attachment includes a plurality of apertures which are substantially aligned with the apertures of the shaft, butt end, and recoil adjusting plate when the anchoring component is oriented against the butt end, such that the associated couplers of the firearm and recoil adjusting plate can be employed to secure the blade attachment to the firearm.

A further aspect of an example embodiment in the present disclosure is to provide a combined firearm and blade assembly which does not require deployment of the blade attachment. Accordingly, the present disclosure provides the blade component and the anchoring component which converge to define a pocket within which the butt end sits when it is mounted to the firearm. The blade component includes a blade which extends downwardly from the butt end of the firearm, the blade having a blade edge which extends longitudinally along the shaft.

Yet a further aspect of an example embodiment in the present disclosure provides the blade attachment having a blade capable of inflicting injury using various thrusts and combat movements. Accordingly, the present disclosure provides the blade component having a blade which is selected from an assortment of blades of various shapes and sizes, the blades which may be fixedly coupled and/or selectively removable from the blade component to enable customizable use of the blade attachment.

Accordingly, the present disclosure describes a blade attachment adapted for use with a firearm having a recoil adjusting plate with a plate aperture and a recoil adjusting plate coupler, as part of a combined firearm and blade assembly. The firearm has a stock with a butt end having a butt end aperture. The firearm has a rear stock aperture and a rear stock coupler. The attachment has an anchoring component including a tongue having a tongue aperture, and a blade component including a collar having a collar aperture and a blade. A method for coupling the attachment to the firearm includes inserting the tongue between the plate and the butt end, aligning the tongue aperture with the plate aperture and butt end aperture, aligning the collar aperture with the rear stock aperture, and employing the plate coupler and rear stock coupler to secure the blade attachment therebetween. The blade can have variably shaped blade edges.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
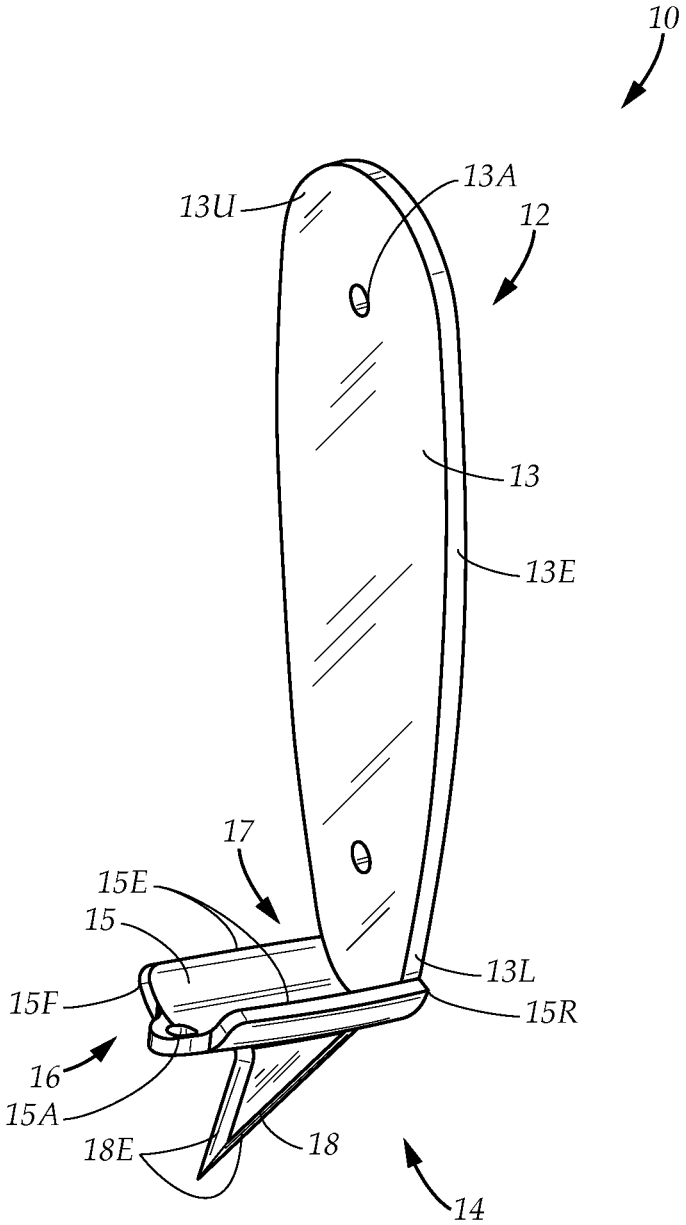
FIG. 1 is a diagrammatic perspective view of a first example embodiment of a blade attachment having an anchoring component and a blade component, the blade attachment adapted for use with a firearm, according to the present disclosure.
Figure 2:
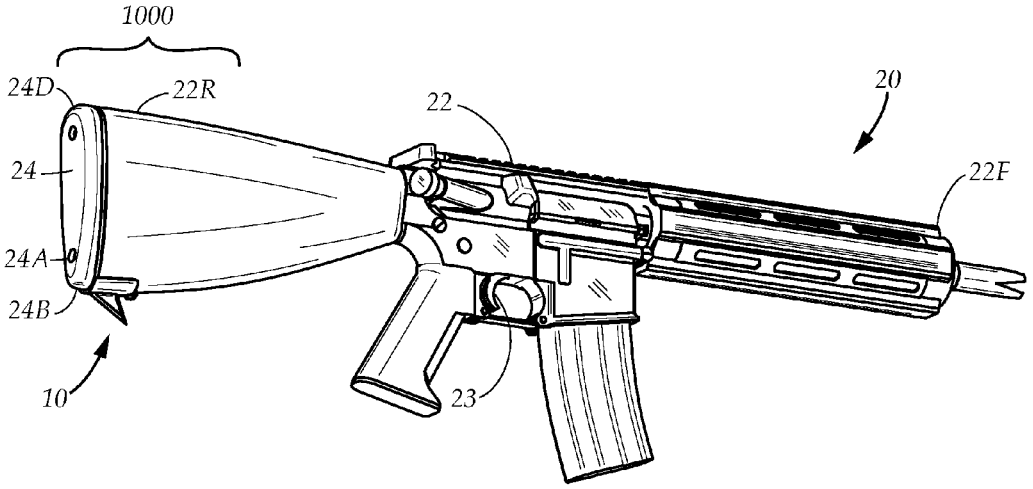
FIG. 2 is a diagrammatic perspective view of the firearm having a butt end, and the blade attachment operably mounted onto the butt end, according to the present disclosure.
Figure 4:
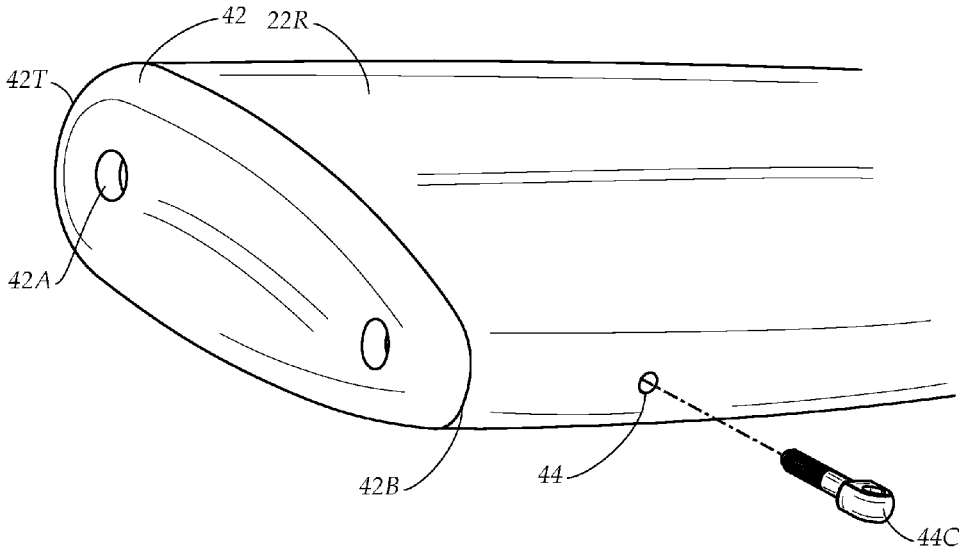
FIG. 4 is an enlarged, perspective view of the butt end of the firearm having a rear stock aperture and a rear stock coupler, and showing the rear stock coupler before insertion to the rear stock aperture, according to the present disclosure.

FIGS. 1 and 2 illustrate an example embodiment of a blade attachment 10 adapted for use with a firearm 20 as part of a combined firearm and and blade assembly 1000. The firearm 20 has a stock 22 with a front 22F and a rear 22R, and a trigger 23 oriented therebetween. Referring momentarily to FIG. 4, the rear stock 22R has a butt end 42 and a rear stock aperture 44 with an associated rear stock coupler 44C near the butt end 42. The butt end 42 has a top edge 42T, a bottom edge 42B, and a butt end length extending between the top and bottom edges. The butt end 42 further includes at least one butt aperture 42A extending therethrough between the top and bottom edges 42T,42B, and a butt aperture spacing between the butt aperture 42S and the top and bottom edges 42T,42B. Referring back to FIG. 2, the butt end 42 has a recoil adjusting plate 24. The recoil adjusting plate 24 can be any component which serves to absorb the recoil associated with firing a firearm, including, but not limited to a butt pad or a butt plate. The recoil adjusting plate 24 has a pair of plate ends 24D,24B, a plate length extending between the plate ends, and at least one plate aperture 24A extending through the plate 24 between the plate ends 24D,24B. Like the butt end 42 of the firearm 20, the plate 24 has a plate aperture spacing between the plate aperture 24A and the plate ends 24D,24B which is substantially equal to the butt aperture spacing such that the butt aperture 42A and the plate aperture 24A are aligned. The plate 24 further includes an associated plate coupler 24C, depicted in FIG. 5, for securing the recoil adjusting plate 24 to the butt end 42. The blade attachment 10 is operably coupled to the firearm 20 between the butt end 42 and the recoil adjusting plate 24, as illustrated in FIG. 2. It is understood that the butt end and the recoil adjusting plate can have any number of apertures which may be aligned, and associated plate couplers for securing the two components together.

The blade attachment 10 has an anchoring component 12 and a blade component 14. The anchoring component 12 includes a tongue 13. The tongue 13 can be of variable widths, however, it is preferably thin enough to avoid increasing the distance between the butt end 42 and the trigger 23 of the firearm. The tongue 13 has an upper tongue end 13U and a lower tongue end 13L, and a tongue length extending between tongue ends. The tongue 13 has a tongue aperture 13A extending through the tongue 13 between the tongue ends 13U,13L. The tongue 13 has a tongue aperture spacing between the tongue aperture 13A and the tongue ends 13U,13L which is substantially equal to that of the butt aperture spacing and the plate aperture spacing. When operably coupled between the butt end 42 and the recoil adjusting plate 24, the tongue aperture 13A is substantially aligned with the butt aperture 42A and the plate aperture 24A. The tongue length can be the same and/or shorter than the butt end length and plate length as long as the tongue aperture, butt aperture, and plate aperture remain substantially aligned.

The blade component 14 includes an arcuate collar 15. The arcuate collar has a front collar end 15F and a rear collar end 15R. The collar 15 has a pair of longitudinal edges 15E which curve upwardly to form a channel 16. The channel 16 has a channel width adapted for receiving and extending along the stock 22 towards the front 22F, when the blade attachment 10 is operably coupled to the firearm 20. The collar 15 is operably coupled to the lower tongue end 13L near the rear collar end 15R to form a pocket 17 within which the bottom edge 42B of the butt end 42 can sit. The collar 15 and the tongue 13 can be unitary and/or distinct components which are operably coupled together.

Figure 7A:
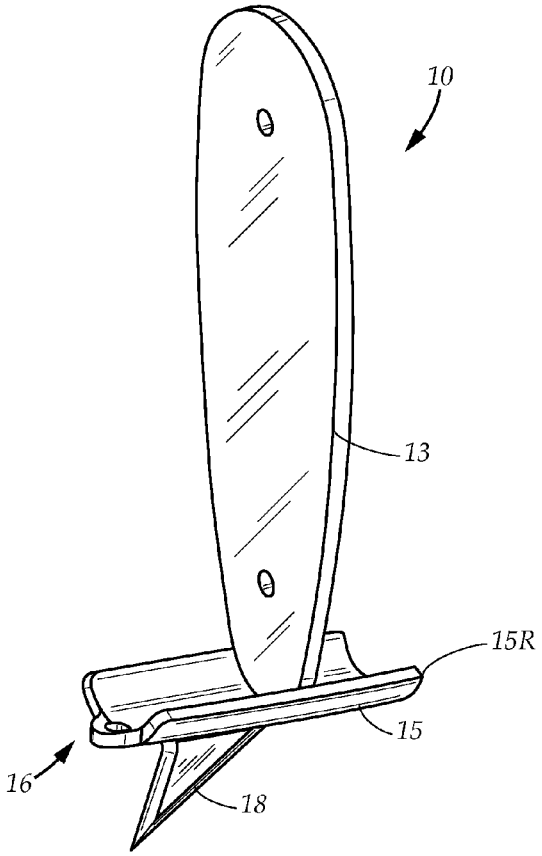
FIG. 7A is a diagrammatic perspective view of a second example embodiment of the blade attachment wherein the blade component includes an extended collar which extends beyond the anchoring component such that it will further extend beneath the recoil adjusting plate when mounted to the firearm, according to the present disclosure.
Figure 7B:
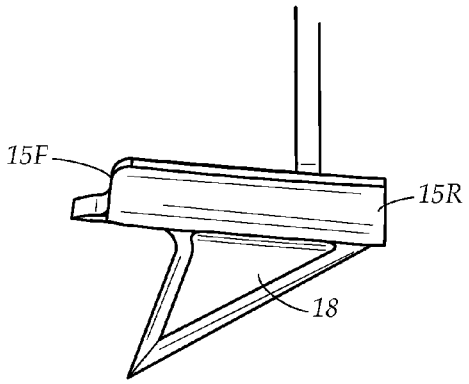
FIG. 7B is a side elevational view of the second example embodiment of the blade attachment showing the blade component having a blade which extends fully across the extended collar, according to the present disclosure.

The tongue 13 has a circumferential edge 13E. In an example embodiment, the collar 15 and the tongue 13 are oriented such that the collar 15 wraps partially around the circumferential edge 13E of the lower tongue end 13L, with the front collar end 15F extending inwardly towards the front of the stock, away from the tongue 13. The recoil adjusting plate 24 has an upper plate end 24D and a lower plate end 24B. In another example embodiment, the collar 15, and therefore the channel 16, is an extended collar wherein the rear collar end 15R extends past the tongue 13 a distance sufficient to also form a partial and/or full collar around the lower plate end 24B, as illustrated in FIG. 7A. The blade can extend partially and/or fully across the extended collar 15 between the front 15F and extended rear collar ends 15R, as illustrated in FIG. 7B.

The collar 15 can also include a collar aperture 15A between the longitudinal edges 15E. The collar aperture 15A has a collar aperture spacing between the collar aperture 15A and the rear collar end 15R which is substantially equal to the rear stock aperture spacing. Accordingly, the collar aperture 15A is coaxial with the rear stock aperture 44 when the blade attachment 10 is operably coupled to the firearm 20. A user can therefore employ the rear stock aperture 44 to further secure the blade attachment 10 to the firearm by extending the rear stock coupler 44C through both the collar aperture 15A and the rear stock aperture 44 in sequence, as illustrated in FIG. 4.

Referring now to FIG. 1, the blade component 14 further includes a blade 18 which extends downwardly away from the collar 15 between the longitudinal edges 15E. The blade 18 has a blade edge 18E which extends parallel to the longitudinal edges 15E between the front and the rear collar ends 15F,15R. The blade edge 18E can extend partially and/or fully along the collar 15. In another example embodiment (not illustrated), the blade is a wedge having a pair of sides which taper from a longitudinal edge of the collar towards the blade edge. The sides may be straight and/or arc inwardly towards one another. The collar and the blade may be unitary and/or distinct components operably coupled together. In a further example embodiment (not illustrated), the blade is selectively removable from the collar. For instance, the collar can include a track within which the blade is configured to selectively engage. Such an embodiment enables a user to seamlessly and quickly switch the blade employed when using the blade attachment in close combat.

Figure 3A:
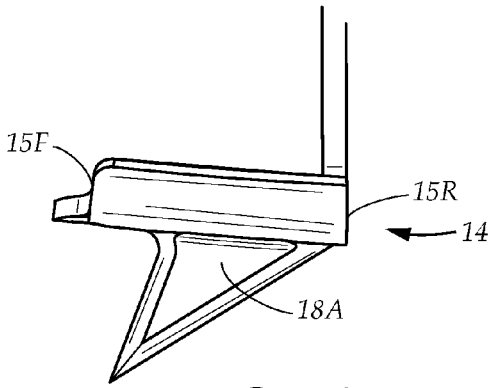
FIG. 3A is a side elevational view of the first example embodiment of the blade component, according to the present disclosure.
Figure 3B:
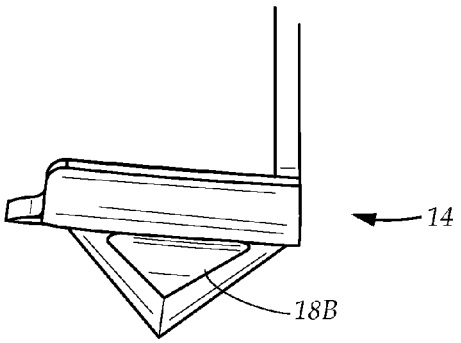
FIG. 3B is a side elevational view of a second example embodiment of the blade component, according to the present disclosure.
Figure 3C:
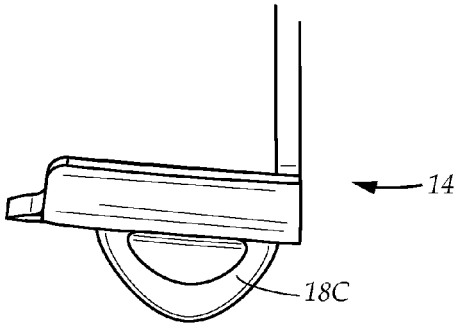
FIG. 3C is a side elevational view of a third example embodiment of the blade component, according to the present disclosure.

FIGS. 3A, 3B, and 3C illustrate example embodiments of the types and shapes of blades which may be operably coupled to a firearm via the blade attachment 10, such as an arrow head 18A, a right triangle blade18B, and a rounded blade 18C. It is understood that these embodiments are merely exemplary, and do not limit the blades which may be employed. The blade 18 can extend partially and/or fully between the front collar end 15F and the rear collar end 15R. Further, in the example embodiment illustrated in FIG. 7A, the blade 18 can extend past the tongue 13 of the blade attachment 10 and the butt end 42 so that the blade 18 too extends further under the recoil adjusting plate 24.

Figure 5:
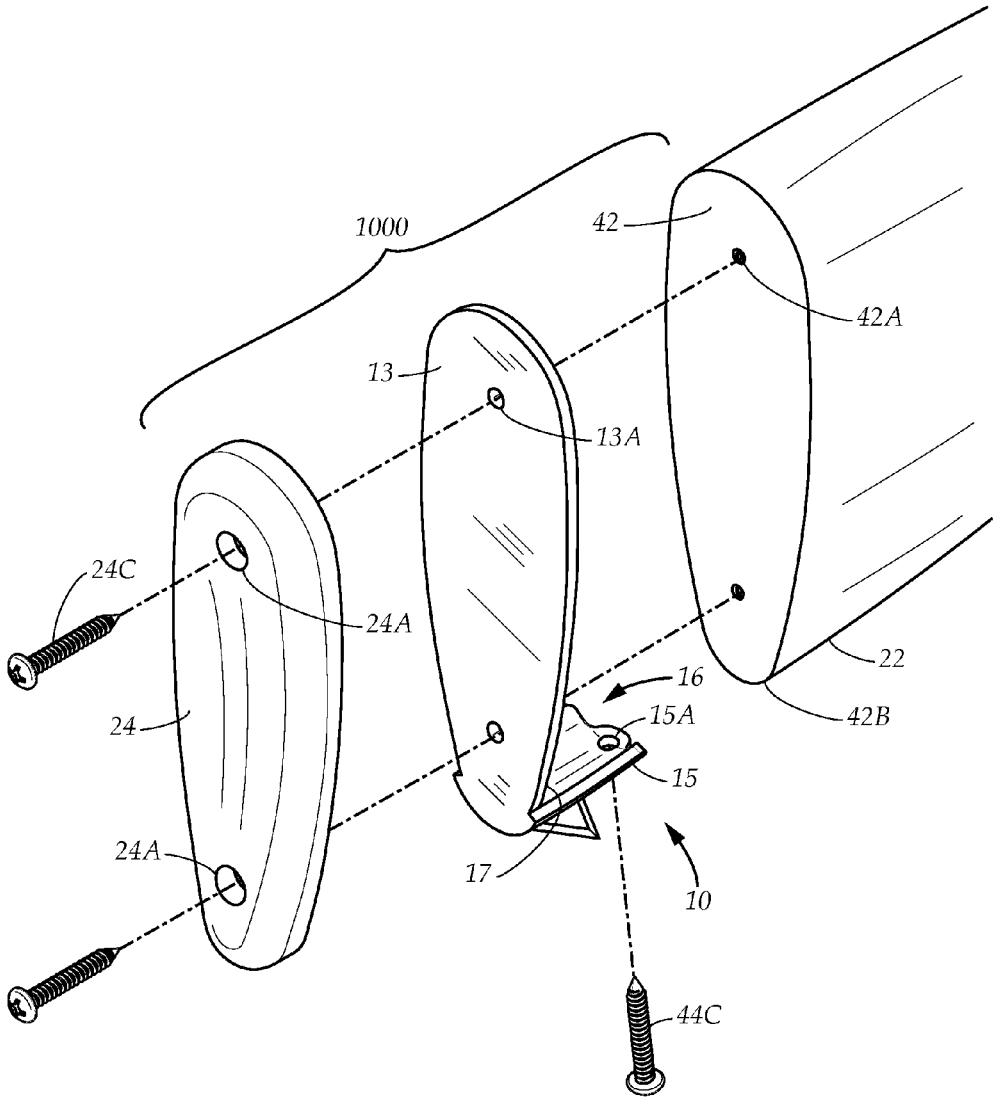
FIG. 5 is an enlarged, perspective view of the butt end of the firearm having a recoil adjusting plate and a pair of plate couplers, and showing the orientation of the anchoring component between the recoil adjusting plate and the butt end before the plate couplers and the rear stock coupler are inserted to secure the anchoring component therebetween, according to the present disclosure.

FIGS. 2 and 5 illustrate an example method for retroactively fitting the blade attachment 10 to the firearm 20 to assemble the combined firearm and blade assembly 1000. The recoil adjusting plate 24 has been separated from the butt end 42 by uncoupling the plate couplers 24C from the plate apertures 24A. The tongue 13 is oriented flush against the butt end 42 between the butt end 42 and the recoil adjustment plate 24. The collar 15 is configured to slide below the shaft 22 via the channel 16 until the bottom edge 42B of the butt end 42 sits within the pocket 17. In the example embodiment illustrated in FIG. 5, the tongue 13, the butt end 42, and the recoil adjusting plate 24 have a shape that is substantially the same, however, it is understood that this is a non-limiting example. Of particular note, the butt end aperture 42A, the tongue aperture 13A, and the plate aperture 24A are substantially aligned, irrespective of the shapes of the butt end, tongue, and recoil adjusting plate. Further, the collar aperture 15A is aligned with the rear stock aperture 44. The plate coupler 24C, or plate couplers as illustrated in FIG. 5, are inserted through the associated plate apertures 24A, the tongue apertures 13A, and the butt end apertures 42A, in sequence. The step of further securing the blade attachment 10 to the firearm comprises inserting the rear stock coupler 44C through the collar aperture 15A and then the rear stock aperture 44. It is understood that the recoil adjusting plate, the tongue, the collar, the rear stock, and the butt end of the gun may include additional apertures which can be coaxially aligned according to the method described hereinabove for insertion of the associated couplers therethrough to secure the blade attachment to the firearm.

Figure 6:
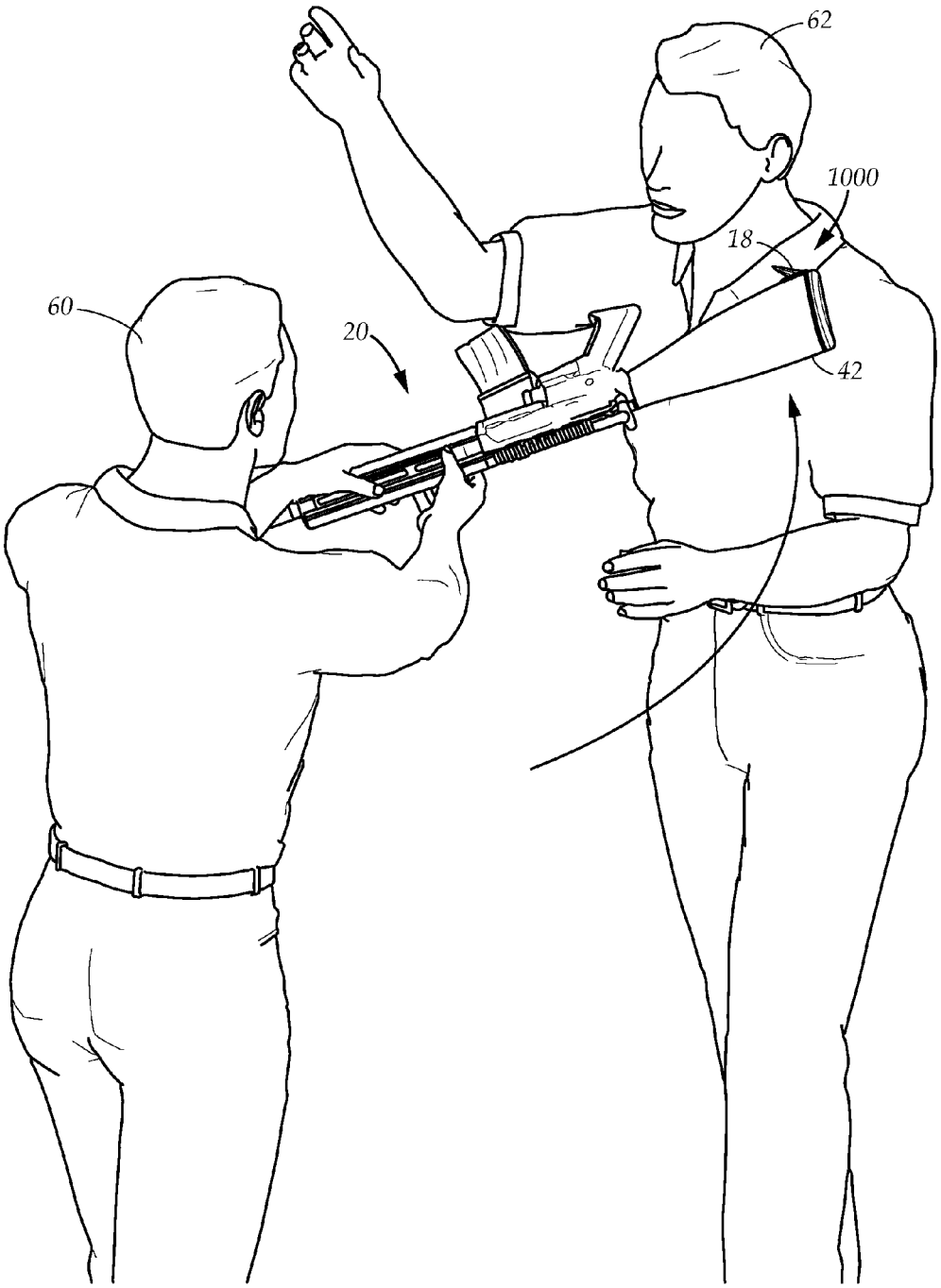
FIG. 6 is a diagrammatic perspective view of a user engaged in close combat with an assailant, the user having a firearm with the blade attachment mounted thereon to enable use of the firearm as a close combat weapon, according to the present disclosure.

FIG. 6 illustrates the combined firearm and blade attachment assembly 1000 in use by a user 60 while engaged in close combat with an aggressor 62. The user 60 can run out of ammunition while in close proximity with the aggressor 62. Alternatively, the user 60 can seek to use another weapon to protect himself against the aggressor 62 and/or inflict harm on the aggressor. Accordingly, the user 60 may flip the firearm 20, holding the barrel and/or shaft 22, to orient the butt end 42 of the towards the aggressor 62, with the bottom edge of the butt end, and therefore the blade 18, facing the user's left side (or right sidedepending on the user's dominant hand). The user 60 may then swing the butt end 42 towards the aggressor 62 in the direction that the blade 18 is facing, using the blade 18 as a secondary weapon. Handling the firearm by the shaft and/or barrel, as illustrated in FIG. 6, enables the user to extend his reach when swinging the blade towards the aggressor while maintaining a greater distance from the aggressor.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a blade attachment for firearms. The disclosure is illustrated by example in the drawing figures, and throughout the written description. It should be understood that numerous variations are possible, while adhering to the inventive concept. Such variations are contemplated as being a part of the present disclosure.

What is claimed is:

1. A blade attachment adapted for extending from a firearm, the firearm having a stock with a front and a rear, the rear having a butt end and a rear stock aperture with an associated rear stock coupler and a rear stock aperture spacing between the rear stock aperture and the butt end, the butt end having a top edge, a bottom edge, a butt end length extending between the top and bottom edges, a butt aperture extending through the butt end between the the top and bottom edges, and a butt aperture spacing between the butt aperture and the top and bottom edges, the butt end further including a recoil adjusting plate, the recoil adjusting plate having a pair of plate ends, a plate aperture extending through the plate between the plate ends, the plate having a plate aperture spacing between the plate aperture and the plate ends which is substantially equal to the butt aperture spacing such that the butt aperture and the plate aperture are aligned, and an associated plate coupler for securing the recoil adjusting plate to the butt end, the blade attachment further enabling use of the firearm as a weapon for close combat encounters, comprising:

a tongue, the tongue having an upper tongue end and a lower tongue end, and a tongue aperture extending through the tongue between the tongue ends, the tongue having a tongue aperture spacing between the tongue aperture and the tongue ends, such that the tongue aperture spacing is substantially equal to the butt aperture spacing and the plate aperture spacing;

an arcuate collar, the collar having a front collar end, a rear collar end, and a pair of longitudinal edges, the longitudinal edges curving upwardly to form a channel having a channel width adapted for receiving and extending along the stock, the collar operably coupled to the lower tongue end near the rear collar end to form a pocket; and a blade extending downwardly away from the collar between the longitudinal edges, the blade having a blade edge which extends parallel to the longitudinal edges between the front and rear collar ends, wherein the tongue is adapted for insertion between the butt end and the recoil adjusting plate until the bottom edge of the firearm is oriented and secured within the pocket with the collar extending along the stock towards the front, and the plate coupler extends through the plate aperture and tongue aperture for securing the tongue between the firearm and the recoil adjusting plate.

2. The blade attachment as recited in claim 1, wherein the arcuate collar includes a collar aperture between the longitudinal edges, the collar aperture has a collar aperture spacing between the collar aperture and the rear collar end which is substantially equal to the rear stock aperture spacing such that the collar aperture is coaxial with the rear stock aperture when the blade attachment is operably coupled to the firearm, the rear stock coupler extending through the collar aperture and the rear stock aperture for further securing the blade attachment to the firearm.

3. The blade attachment as recited in claim 2, wherein the rear collar end extends past the lower tongue end when forming the pocket such that the blade can also extend past the rear stock end of the firearm when the bottom edge of the butt end is oriented within the pocket.

4. The blade attachment as recited in claim 3, wherein the tongue, collar, and blade are of unitary construction.

5. The blade attachment as recited in claim 2, wherein the tongue, collar, and blade are of unitary construction.

6. The blade attachment as recited in claim 2, wherein the tongue has a tongue length between the upper and lower tongue ends which is substantially equal to the butt end length.

7. The blade attachment as recited in claim 6, wherein the blade is a wedge which tapers towards the blade edge.

8. The blade attachment as recited in claim 6, wherein the blade has a shape selected from the group consisting of an arrowhead, a triangle, and a semicircle.

9. A combined firearm and blade assembly, comprising:

a firearm having a stock with a front and a rear, the rear having a butt end and a rear stock aperture with an associated rear stock coupler and a rear stock aperture spacing between the rear stock aperture and the butt end, the butt end having a top edge, a bottom edge, a butt end length extending between the top and bottom edges, a butt aperture extending through the butt end between the the top and bottom edges, and a butt aperture spacing between the butt aperture and the top and bottom edges, the butt end further including a recoil adjusting plate, the recoil adjusting plate having a pair of plate ends, a plate aperture extending through the plate between the plate ends, the plate having a plate aperture spacing between the plate aperture and the plate ends which is substantially equal to the butt aperture spacing such that the butt aperture and the plate aperture are aligned, and an associated plate coupler for securing the recoil adjusting plate to the butt end;

an anchoring component, the anchoring component having an upper anchoring end and a lower anchoring end, and an anchoring aperture extending thorugh the anchoring component between the ends, the anchoring component having an anchoring aperture spacing between the anchoring aperture and the anchoring component ends, such that the anchoring aperture spacing is substantially equal to the plate aperture spacing;

a blade component having a front blade end, a rear blade end, and a pair of longitudinal edges, the longitudinal edges curving upwardly to form a channel having a channel width adapted to receive and extend along the stock, the blade component operably coupled to the lower end of the anchoring component near the rear blade end to form a pocket, the blade component having a blade extending downwardly away from the channel between the longitudinal edges, the blade having a blade edge which extends parallel to the longitudinal edges between the front blade end and the rear blade end of the blade component; and wherein the anchoring component is adapted for insertion between the butt end and the recoil adjusting plate of the firearm until the bottom edge is oriented and secured within the pocket with the blade component extending along the stock towards the front, and the plate coupler extends through the plate aperture and anchoring aperture for securing the anchoring component between the firearm and the recoil adjusting plate.

10. The combined firearm and blade assembly as recited in claim 9, wherein the blade component includes a blade component aperture between the longitudinal edges, the blade component aperture has a blade component aperture spacing between the blade component aperture and the rear blade end which is substantially equal to the rear stock aperture spacing such that the blade component aperture is coaxial with the rear stock aperture, the rear stock coupler extending through the blade component aperture and the rear stock aperture for further securing the blade assembly to the firearm.

11. The combined firearm and blade assembly as recited in claim 10, wherein the rear blade end extends past the lower anchoring end when forming the pocket such that the blade can also extend past the rear stock end of the firearm when the bottom edge of the butt end is oriented within the pocket.

12. The combined firearm and blade assembly as recited in claim 10, wherein the anchoring component, and the blade component are of unitary construction.

13. The combined firearm and blade assembly as recited in claim 10, wherein the anchoring component has an anchoring component length between the upper and lower anchoring ends which is substantially equal to the butt end length.

14. The combined firearm and blade assembly as recited in claim 13, wherein the blade is a wedge which tapers towards the blade edge.

15. The combined firearm and blade assembly as recited in claim 13, wherein the blade has a shape selected from the group consisting of an arrowhead, a triangle, and a semicircle.

* * * * *